US007181782B2

(12) United States Patent
Mayer

(10) Patent No.: US 7,181,782 B2
(45) Date of Patent: Feb. 27, 2007

(54) BASIN DRAINAGE SYSTEM FOR COUNTERACTING STANDING LIQUID

(75) Inventor: Robert H. Mayer, Fort Lauderdale, FL (US)

(73) Assignee: Decolav, Inc., Deerfield Beach, FL (US)

( * ) Notice: Subject to any disclaimer, the term of this patent is extended or adjusted under 35 U.S.C. 154(b) by 291 days.

(21) Appl. No.: 10/872,802

(22) Filed: Jun. 21, 2004

(65) Prior Publication Data

US 2005/0278847 A1 Dec. 22, 2005

(51) Int. Cl.
*E03C 1/232* (2006.01)

(52) U.S. Cl. ..... 4/686

(58) Field of Classification Search ..... 4/650, 4/686–687, 651; 137/362; 210/166
See application file for complete search history.

(56) References Cited

U.S. PATENT DOCUMENTS 2,782,057 A 2/1957 Moore, Jr.
3,393,409 A 7/1968 Politz
3,411,628 A 11/1968 Mason
3,495,280 A 2/1970 Galbiati
3,940,807 A 3/1976 Baker et al.
4,146,939 A 4/1979 Izzi
5,022,430 A 6/1991 Degooyer
5,271,108 A 12/1993 Wicke
5,274,861 A 1/1994 Ford
5,645,103 A * 7/1997 Whittaker ..... 137/312
6,219,861 B1 4/2001 Chen
6,341,391 B1 1/2002 Cheng
6,763,533 B2 * 7/2004 Mayer et al. ..... 4/650
2003/0213063 A1 11/2003 Mayer et al.

* cited by examiner

*Primary Examiner*—Charles E. Phillips
(74) *Attorney, Agent, or Firm*—Steven M. Greenberg, Esq.; Carey, Rodriguez, Greenberg & Paul, LLP

(57) ABSTRACT

A basin drainage system for counteracting standing liquid can include a basin drain having at least one exterior wall defining a drainage channel formed through an interior portion of the basin drain. The system also can include a downwardly sloping flange affixed to the exterior wall of the basin drain. Finally, the system can include axial drainage channels formed in the downwardly sloping flange.

3 Claims, 2 Drawing Sheets

BASIN DRAINAGE SYSTEM FOR COUNTERACTING STANDING LIQUID

FIELD OF THE INVENTION

The present invention relates to basin hardware and more particularly to basin drainage systems.

BACKGROUND OF THE INVENTION

Basin drainage systems enable the draining of liquid from a liquid holding basin, such as a sink or tub, through to a plumbing system such as the centralized plumbing and waste removal systems ordinarily found in residential and commercial structures and shelters. Generally speaking, drainage systems include a drain which can be coupled to an orifice at or near the bottom of the basin. A plumbing system having a drain pipe can be coupled to the bottom of the basin from an opposite end of the orifice. Alternatively, the drain pipe can be coupled directly to an opposing end of the drain. In either case, a drainage port can be formed within the drain through which liquid in the basin can flow into the plumbing system. Notably, most drainage systems include a stopper or drain plug with which the flow through the drainage port can be restricted if not halted altogether.

U.S. Pat. No. 3,495,280 to Galbiati discloses a sink drainage system in which a collar protruding circumferentially from a drain can engage the interior portion of a sink at the sink orifice. As such, liquid can flow from the sink towards the drainage channel in the drain over the collar. U.S. Pat. No. 6,219,861 to Chen similarly illustrates a conventional drainage system in which a docking collar also can couple snuggly to the orifice of sink to allow the flow of liquid from the sink into the drain. Importantly, in both the case of Galbiati and Chen, it will be apparent to the skilled artisan that some liquid can become trapped at the intersection of the collar and the drain. Moreover, liquid can seep below the collar into the void between the sink orifice rim and the bottom of the collar.

When standing liquid is allowed to persist within the void of a drainage system, several undesirable conditions can result. Most notably, mold can form where the liquid is water. Also, where the liquid is corrosive in nature, the sink can rot in the vicinity of the drain orifice. In either case, at a minimum, an unattractive discoloration of the sink can develop giving the appearance of generally unsanitary conditions. Thus, it would be desirable to avoid the standing liquid problem associated with the docking collar of the conventional drainage system.

SUMMARY OF THE INVENTION

The present invention advantageously provides a basin drainage system which overcomes the standing liquid limitations of the prior art and provides a novel and non-obvious drainage system which facilitates the drainage of liquid through the drainage channel of a drain while avoiding standing liquid pools about the drain. A basin drainage system which has been configured in accordance with the present invention can include a basin drain having at least one exterior wall defining a drainage channel formed through an interior portion of the basin drain. The system also can include a downwardly sloping flange affixed to the exterior wall of the basin drain. Finally, the system can include axial drainage channels formed in the downwardly sloping flange.

Preferably, one or more liquid inlets can be formed in the exterior wall. As such, the downwardly sloping flange can be affixed to the exterior wall below the liquid inlets. One or more spillways can be included, wherein each spillway can be formed from each intersection of one of the axial drainage channels with a bottom edge of one of the liquid inlets. Additionally, connecting structure can be positioned below the downwardly sloping flange. Notably, the downwardly sloping flange can have an angle of descent ranging from one to five degrees. Also, the downwardly sloping flange can include a sloped bottom surface having an angle of ascent which ranges from ninety-five degrees to one-hundred and ten degrees. Finally, the downwardly sloping flange can include a substantially flat perimeter surface about an outside perimeter of the downwardly sloping flange.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention is a basin drainage system configured to drain liquid in a basin while avoiding standing water about the orifice of the basin. A basin drainage system which has been configured in accordance with the present invention can include a drain having a drainage channel formed there through for allowing liquid to drain from a top portion of the drain through to a bottom portion of the drain. The drain can include connecting structure such as connecting threads for coupling the bottom portion of the drain to a plumbing system. Additionally, a flange can extend circumferentially from the outer surface of the drain such that the bottom surface of the flange can act as a collar for mating with the perimeter of a basin orifice, for example a sink or tub drain hole.

Importantly, to prevent standing liquid, the top surface of the flange can intersect the exterior portion of the drain at an angle less than ninety degrees. To the extent that the top and bottom surfaces of the flange are substantially parallel, an angle greater than ninety degrees can be formed between the bottom surface of the flange and the exterior portion of the drain. In this way, liquid flowing across the top surface of the flange can be encouraged by the downwardly sloping nature of the flange to drain more quickly towards the drainage channel. Significantly, to further avoid standing liquid, one or more axial liquid channels can be formed in the flange so as to extend along a radial axis from the exterior surface of the drain. As a result, the combined action of the sloped flange and axial liquid channels can encourage liquid flowing across the top surface of the flange to be guided towards the drain in the liquid channels.

Figure 1:
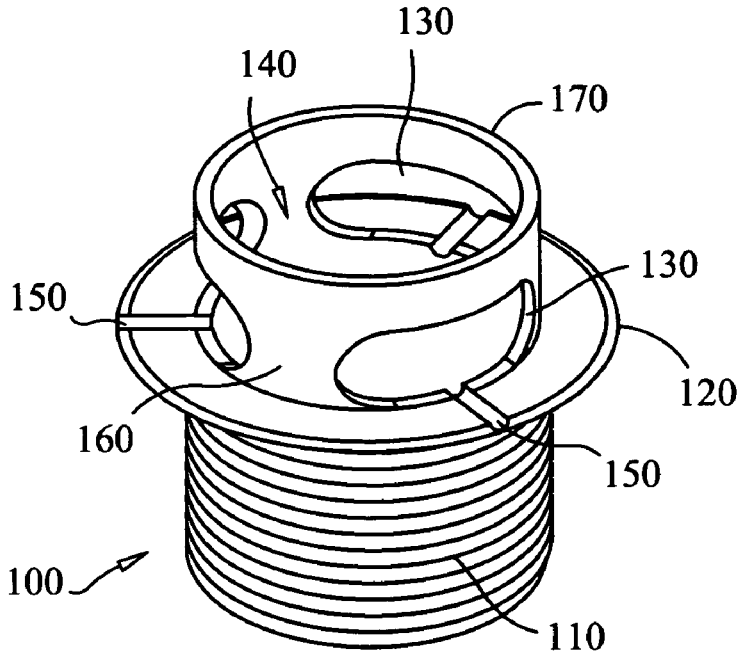
FIG. 1 is a perspective view of a basin drainage system which has been configured in accordance with the inventive arrangements.

In further illustration of the foregoing inventive arrangement, FIG. 1 is a perspective view of a basin drainage system which has been configured in accordance with a preferred aspect of the present invention. As shown in FIG. 1, a basin drainage system can include a basin drain 100 having a drainage channel 140 formed there through. A bottom portion of the basin drain 100 can include connecting structure 110 configured to couple the basin drain 100 to a plumbing system (not shown). In this regard, the connecting structure 110 can include threaded interconnections, a swage lock or another such connecting mechanism. In any case, the basin drain 110 preferably can be configured to have a cylindrical shape of specified diameter and length so as to pass through the drainage orifice of a basin (not shown), such as a sink or tub. The present invention is not limited to the cylindrical shape of the basin drain 100, however, and other shapes can suffice, including polygonal shapes such as hexagonal and octagonal shapes.

Notably, a flange 120 can be affixed to the basin drain 100 and can extend circumferentially from the exterior wall 160 of the basin drain 100. The flange 120 can be configured so as to fit snuggly against an interior portion of the basin about a drainage orifice in the basin. For instance, the flange 120 can be configured to fit snuggly within a recess formed circumferentially about the drainage orifice in the basin. As shown in FIG. 1, in a preferred albeit non-exclusive aspect of the invention, the flange 120 can be affixed to the exterior wall 160 of the basin drain 100 at a level which falls below the top opening 170 of the basin drain 100. Consequently, a significant portion of the exterior wall 160 of the basin drain 100 can extend above the flange 120 so as to facilitate the use of a drain hat, for example.

As the flange 120 can be affixed to the basin drain 100 at a point on the exterior wall 160 of the basin drain 100 which falls below the top opening 170 of the basin drain 100, one or more spaced liquid inlets 130 can be formed in the exterior wall 160 of the basin drain 100 above the flange 120 so as to permit the flow of liquid from the flange 120 through the liquid inlets 130 into the drainage channel 140. Advantageously, to further guide liquid through the liquid inlets 130 into the drainage channel 140, one or more axial channels 150 can be formed in the flange 120. In this way, liquid can be channeled appropriately across the flange 120 into the liquid inlets 130, thereby avoiding standing liquid about the top surface of the flange 120.

Figure 2:
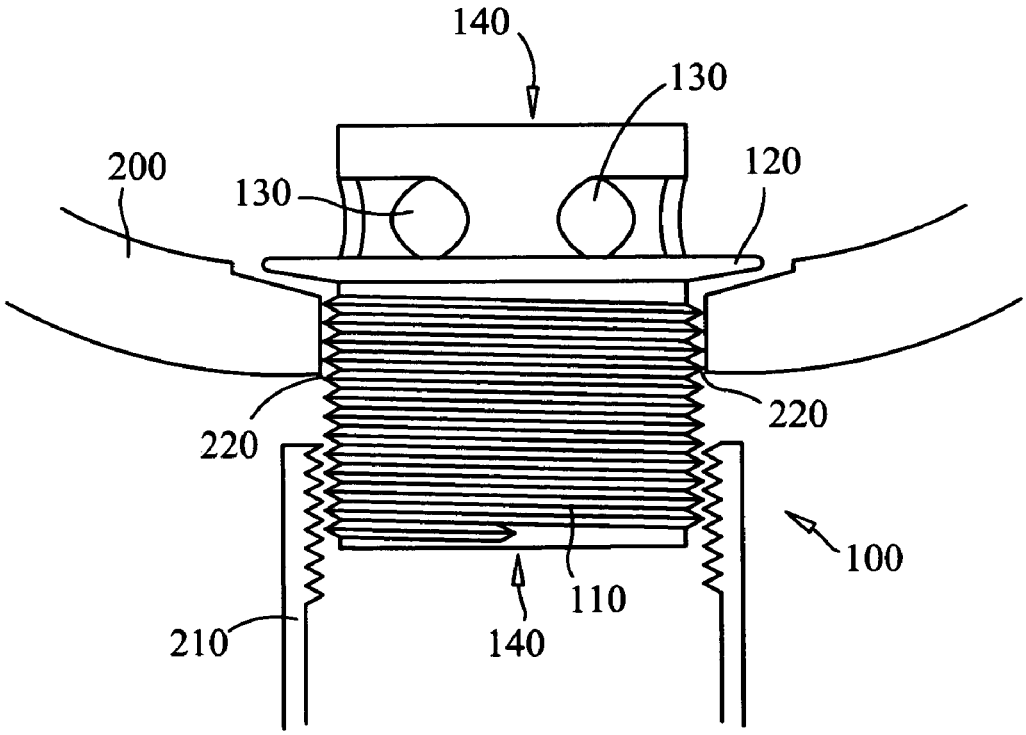
FIG. 2 is a side view of the basin drainage system of FIG. 1.

In more particular illustration, FIG. 2 is a side view of the basin drainage system of FIG. 1. As shown in FIG. 2, the spaced liquid inlets 130 can communicate directly with the flange 120 so as to allow liquid to flow from the flange 120 through the liquid inlets 130 into the drainage channel 140 without providing an opportunity for the liquid to pool at the intersection of the liquid inlets 130 and the flange 120. Moreover, the operation of the connecting structure 110 in coupling the basin drain 100 to a plumbing system 210 below the flange and below the basin 200 can act to force a snug fit between the bottom surface of the flange 120 and the interior surface of the basin 200 about the basin orifice 220 of the basin 200. Where the interior surface of the basin 200 includes a recess about the basin orifice 220, the opportunity for liquid to pool can be further reduced through a snug fitting of the flange 120 in the recess as shown in FIG. 2.

Figure 3:
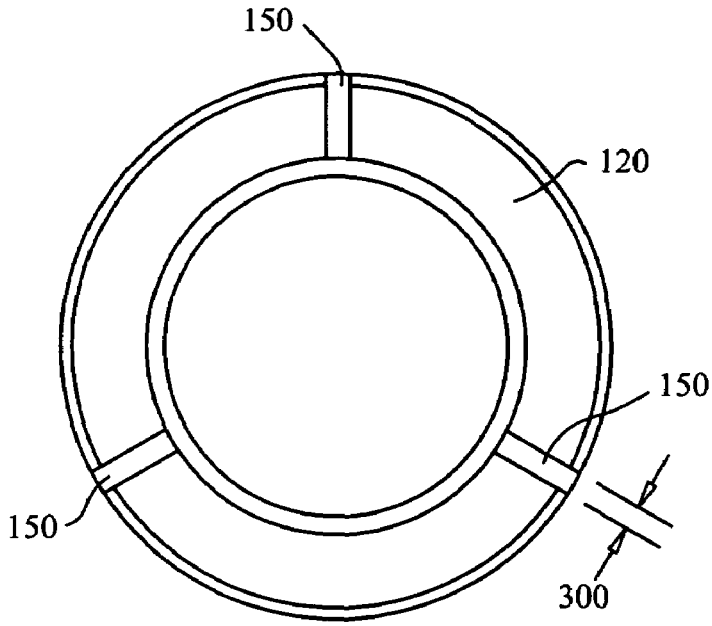
FIG. 3 is a top view of the basin drainage system of FIG. 1.

FIG. 3 is a top view of the basin drainage system of FIG. 1 in which the axial drainage channels 150 are shown to be spaced evenly about the top surface of the flange 120. For example, as shown in FIG. 3, each of the axial drainage channels 150 can be spaced 120 degrees apart from one another, although the invention is not limited to the precise spacing between the axial drainage channels 150. As further shown in FIG. 3, each of the axial drainage channels 150 can be formed in the flange 120 to have sufficient width 300 so as to facilitate the flow of a liquid from the outside perimeter of the flange 120 towards the inside perimeter of the flange 120. In this regard, the width 300 of the channels can range from less than one millimeter to greater than three millimeters—preferably 2.44 millimeters.

Figure 4:
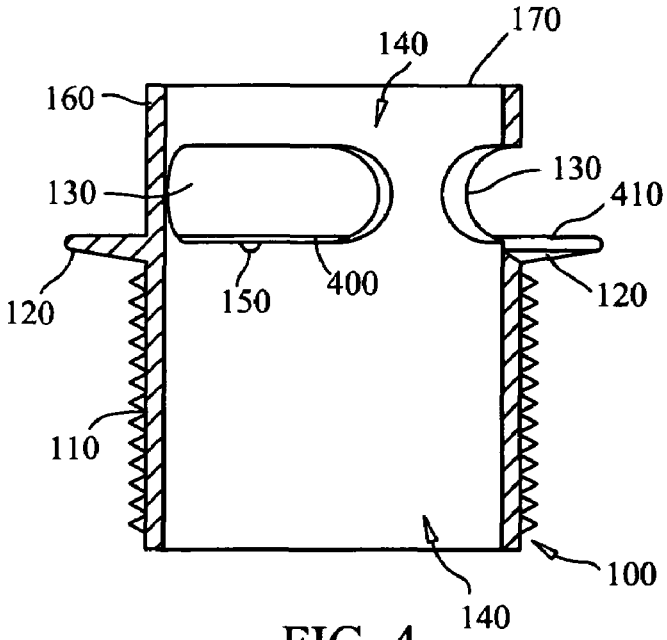
FIG. 4 is a side cut-away view of the basin drainage system of FIG. 1; and, FIG. 5 is a detail view of a side cut-away view of a sloped flange in the basin drainage system of FIG. 1.

FIG. 4 is a side cut-away view of the basin drainage system of FIG. 1 which illustrates the communication between the axial drainage channels 150, the liquid inlets 130 and the basin drainage channel 140. As shown in FIG. 4, the flange 120 can extend circumferentially from the exterior wall 160 of the basin drain 100 at a point below the top surface 170 of the basin drain 100, and above the connecting structure 110. In a preferred aspect of the invention, top surface 410 of the flange 120 can communicate directly with the bottom surface 400 of the liquid inlets 130 so as to avoid the pooling of liquid at the intersection of the flange 120 and the liquid inlets 130. Additionally, the axial drainage channels 150 can be formed in the top surface of 410 of the flange 120 at a point below the bottom surface 400 of the liquid inlets 130. In this way, the intersection of the axial drainage channels 150 and the bottom surface 400 of the liquid inlets 130 can form a spillway of liquid into the basin drainage channel 140.

Figure 5:
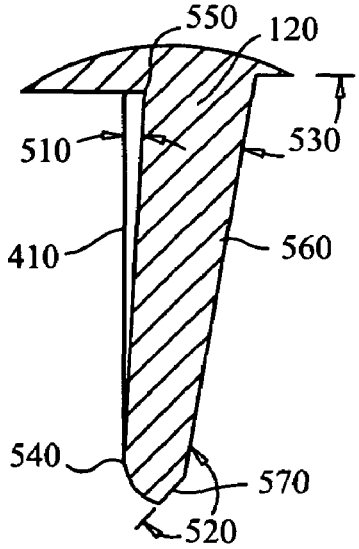

FIG. 5 is a detail view of a side cut-away view of the flange 120 of the basin drainage system of FIG. 1. Importantly, in accordance with the present invention and as shown in FIG. 5, the top surface 410 of the flange 120 can be downwardly sloped, from the outside perimeter 540 of the flange 120, to the inside perimeter 550 of the flange 120. The angle of descent 510 of the slope can be sufficient so as to encourage the enhanced flow of liquid from the outside perimeter 540 to the inside perimeter 550. In this regard, the angle of descent 510 of the slope can be three degrees, though the invention is not limited to the precise angle of descent 510 shown in FIG. 5, so long as the angle of descent is sufficient to force the enhanced inward flow of liquid without inhibiting the ability of the flange 120 to snuggly fit with the interior portion of a basin about the basin orifice. For example, the angle of descent 510 can range from one to five degrees.

To provide a degree of flexibility in fitting the flange 120 to the interior region about a basin orifice in which the diameter and nature of the region can vary, the bottom surface 560 of the flange 120 also can be upwardly sloped by an angle of ascent 530 sufficient to accommodate the traditional diameter range of basin orifices compatible with the basin drain. In this way, the snug communication between the bottom surface 560 of the flange 120 and the circumferential region of the basin orifice can occur at any point on the bottom surface 560 as the flange and basin drain orifice are drawn together. Still, it will be recognized by the skilled artisan that the angle of ascent 530 is to be limited so as to minimize any void created between the outside perimeter 540 of the flange 120 and the point of communication between the bottom surface of the flange 120 and the basin drain orifice. As such, preferably, the angle of ascent can be approximately one-hundred degrees, though the angle of ascent can vary widely, for example, from ninety-five degrees to one-hundred and ten degrees.

Optionally, to provide yet a further level of snugness, a substantially flat perimeter surface 570 can be formed at the outer perimeter 540 of the flange 120 for additional communication with a basin orifice. Again, the positional angle 520 of the perimeter surface 570 can vary, though preferably, the positional angle 520 can be two-hundred and fifteen degrees. In any case, it will be apparent to the skilled artisan that the combined action of the sloping of the flange 120 and the axial drainage channels counteracts the pooling of liquid in and about the basin drain. Accordingly, the use of a basin drainage system as described herein can avoid the deficiencies of known drainage systems.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A basin drain, comprising:

an upper drain body having an interior surface, an exterior surface, a conduit open at both ends and extending along a longitudinal axis of the drain body and defined by the interior surface, and an inlet connecting the exterior surface to the interior surface;

a lower drain body connected to the upper drain body and having connecting structure for connection to a drain conduit; and a flange connected to the exterior surface, wherein the upper drain body and the inlet extend above an upper surface of the flange, the upper surface of the flange downwardly slopes from a distal portion of the flange to a proximal portion of the flange, the upper surface of the flange includes a drainage channel therein, the drainage channel radially extends substantially along the upper surface of the flange, and the channel extends into the inlet.

2. The basin drain of claim 1, wherein the upper surface slopes downwardly from the distal portion at an angle ranging from one to five degrees.

3. The basin drain of claim 1, wherein a lower portion of the flange slopes upwardly from the proximal portion of the flange to the distal portion of the flange.

* * * * *